US010498070B2

(12) United States Patent
Zhou et al.

(10) Patent No.: US 10,498,070 B2
(45) Date of Patent: Dec. 3, 2019

(54) ELECTRICAL CONNECTOR HAVING AN IMPROVED O-RING AND METHOD OF MAKING THE SAME

(71) Applicant: FOXCONN INTERCONNECT TECHNOLOGY LIMITED, Grand Cayman (KY)

(72) Inventors: Shao-Cong Zhou, Huaian (CN); Jun Zhao, Huaian (CN); Gang Hu, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/112,783

(22) Filed: Aug. 27, 2018

(65) Prior Publication Data

US 2019/0067867 A1 Feb. 28, 2019

(30) Foreign Application Priority Data

Aug. 25, 2017 (CN) ..... 2017 1 0742269

(51) Int. Cl.
*H01R 13/52* (2006.01)
*H01R 13/6581* (2011.01)
(Continued)

(52) U.S. Cl.
CPC ..... *H01R 13/5202* (2013.01); *H01R 13/504* (2013.01); *H01R 13/5216* (2013.01);
(Continued)

(58) Field of Classification Search
CPC ..... H01R 13/5202; H01R 13/504; H01R 13/5216; H01R 43/005
(Continued)

(56) References Cited

U.S. PATENT DOCUMENTS 8,808,035 B2 * 8/2014 Wu ..... H01R 24/58 439/668
8,827,742 B2 * 9/2014 Wang ..... H01R 24/68 439/569
(Continued)

FOREIGN PATENT DOCUMENTS

CN 206211078 U 5/2017
CN 206340732 U 7/2017
(Continued)

*Primary Examiner* — Alexander Gilman
(74) *Attorney, Agent, or Firm* — Wei Te Chung; Ming Chieh Chang

(57) ABSTRACT

An electrical connector assembly includes an electrical connector and an outer frame receiving the electrical connector. The electrical connector includes an insulative housing, a number of conductive terminals affixed to the insulative housing, and a shielding shell enclosing the insulative housing. The insulative housing includes a base portion and a tongue portion. There exists an annular groove between an outer surface of the shielding shell and an inner wall of the outer frame. The outer frame includes a number of dispensing holes penetrating the inner wall and an outer wall thereof and communicating with the annular groove. An o-ring is injected into the annular groove through the dispensing holes by the insulative materials sealing a gap between the shielding shell and the outer frame. Since the o-ring is formed after assembling the electrical connector to the outer frame, the gap is better sealed.

18 Claims, 12 Drawing Sheets

(51) Int. Cl.

| | |
|---|---|
| ***H01R 13/504*** | (2006.01) |
| ***H01R 43/00*** | (2006.01) |
| *H01R 12/72* | (2011.01) |
| *H01R 43/20* | (2006.01) |
| *H01R 24/60* | (2011.01) |

(52) U.S. Cl.
CPC ..... *H01R 13/6581* (2013.01); *H01R 43/005* (2013.01); *H01R 12/724* (2013.01); *H01R 24/60* (2013.01); *H01R 43/20* (2013.01)

(58) Field of Classification Search
USPC ..... 439/589
See application file for complete search history.

(56) References Cited

U.S. PATENT DOCUMENTS

| | | | | |
|---|---|---|---|---|
| 9,112,299 | B2 * | 8/2015 | Lu | H01R 13/5227 |
| 9,130,301 | B2 * | 9/2015 | Lu | H01R 13/521 |
| 9,136,616 | B2 * | 9/2015 | Zhao | H01R 12/724 |
| 9,263,836 | B2 * | 2/2016 | Zhao | H01R 24/60 |
| 9,293,869 | B2 * | 3/2016 | Ning | H01R 13/6594 |
| 9,444,177 | B2 * | 9/2016 | Tsai | H01R 13/5202 |
| 9,553,410 | B2 * | 1/2017 | Zhao | H01R 13/6581 |
| 9,608,359 | B2 * | 3/2017 | Arai | H01R 12/716 |
| 9,634,425 | B1 * | 4/2017 | Hsu | H01R 13/5202 |
| 9,685,737 | B2 * | 6/2017 | Tsai | H01R 13/6585 |
| 9,742,098 | B2 * | 8/2017 | Zhao | H01R 13/5202 |
| 9,768,544 | B2 * | 9/2017 | Du | H01R 13/521 |
| 9,853,393 | B2 * | 12/2017 | Guo | H01R 13/405 |
| 9,935,393 | B2 * | 4/2018 | Tada | H01R 12/724 |
| 9,997,862 | B2 * | 6/2018 | Zhou | H01R 13/6275 |
| 10,044,148 | B2 * | 8/2018 | Zhao | H01R 13/6581 |
| 10,128,596 | B2 * | 11/2018 | Tsai | H01R 12/716 |
| 10,199,763 | B2 * | 2/2019 | Zhu | H01R 13/5202 |
| 2003/0045179 | A1 * | 3/2003 | Trogisch | B29C 45/14639 439/722 |
| 2012/0315779 | A1 * | 12/2012 | Yudate | H01R 12/724 439/271 |
| 2013/0115821 | A1 * | 5/2013 | Golko | H01R 13/516 439/638 |
| 2013/0183845 | A1 * | 7/2013 | Tan | H01R 13/5202 439/271 |
| 2017/0250495 | A1 * | 8/2017 | Yudate | H01R 13/5202 |
| 2017/0365955 | A1 * | 12/2017 | Li | H01R 13/5202 |
| 2018/0109027 | A1 * | 4/2018 | Kaneko | B60R 16/02 |
| 2018/0205172 | A1 * | 7/2018 | Zhao | H01R 13/5202 |
| 2019/0067867 | A1 * | 2/2019 | Zhou | H01R 13/5202 |

FOREIGN PATENT DOCUMENTS

| | | |
|---|---|---|
| CN | 107404033 A | 11/2017 |
| CN | 108155495 A | 6/2018 |
| TW | M464856 | 11/2013 |

* cited by examiner

ELECTRICAL CONNECTOR HAVING AN IMPROVED O-RING AND METHOD OF MAKING THE SAME

BACKGROUND OF THE DISCLOSURE

1. Field of the Disclosure

The present disclosure relates to an electrical connector, and more particularly to an electrical connector having an improved waterproof effect.

2. Description of Related Arts

Taiwan Patent No. M464856 discloses an electrical connector including an insulative housing, a number of conductive terminals received in the insulative housing, a metal shielding shell surrounding the insulative housing to form an accommodation space, and an insulative shell enclosing the metal shielding shell. The electrical connector further includes an o-ring attached to the insulative shell. Although the front end of the electrical connector is provided with the o-ring for filling the gap between the electronic device and the electrical connector, the excessive force may cause the o-ring to be misaligned or not completely fill the gap between the electronic device and the electrical connector during assembling.

An improved electrical connector is desired.

SUMMARY OF THE DISCLOSURE

Accordingly, an object of the present disclosure is to provide an electrical connector with an improved o-ring to improve waterproof effect between the electrical connector and the electronic device.

To achieve the above object, an electrical connector assembly includes an electrical connector and an outer frame receiving the electrical connector. The electrical connector includes an insulative housing, a number of conductive terminals affixed to the insulative housing, and a shielding shell enclosing the insulative housing. The insulative housing includes a base portion and a tongue portion extending forwardly from the base portion. The shielding shell is affixed with the base portion. There exists an annular groove between an outer surface of the shielding shell and an inner wall of the outer frame, the outer frame includes a number of dispensing holes penetrating the inner wall and an outer wall thereof and communicating with the annular groove, and an o-ring is injected into the annular groove through the dispensing holes by the insulative materials to seal a gap between the shielding shell and the outer frame. Since the o-ring is formed after filling the electrical connector into the outer frame, the gap between the outer frame and the electrical connector could be better sealed, and a good waterproof effect is achieved.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
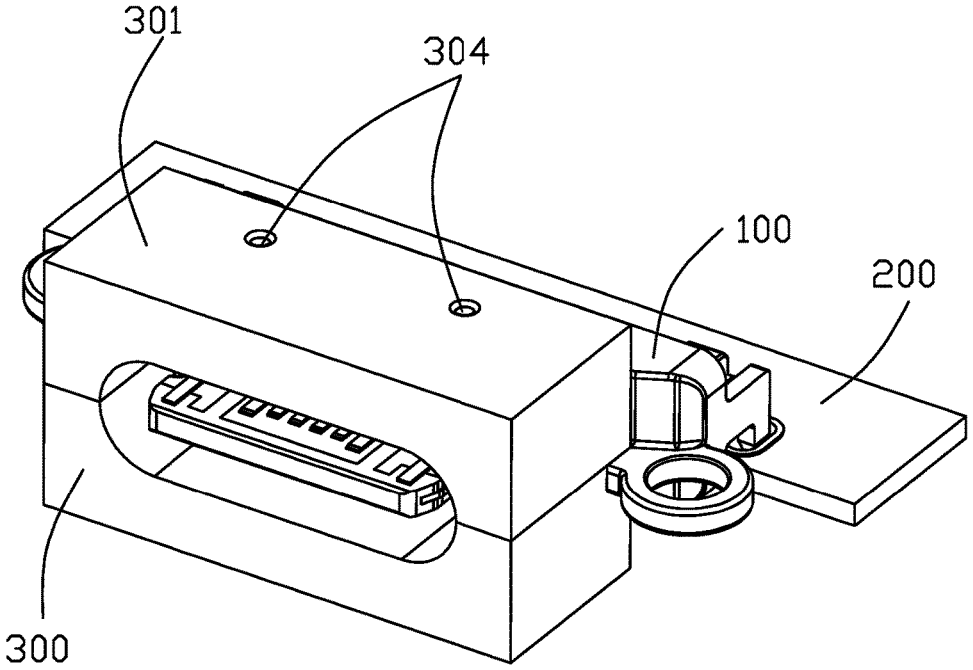
FIG. 1 is a perspective, assembled view of an electrical connector assembly.
Figure 2:
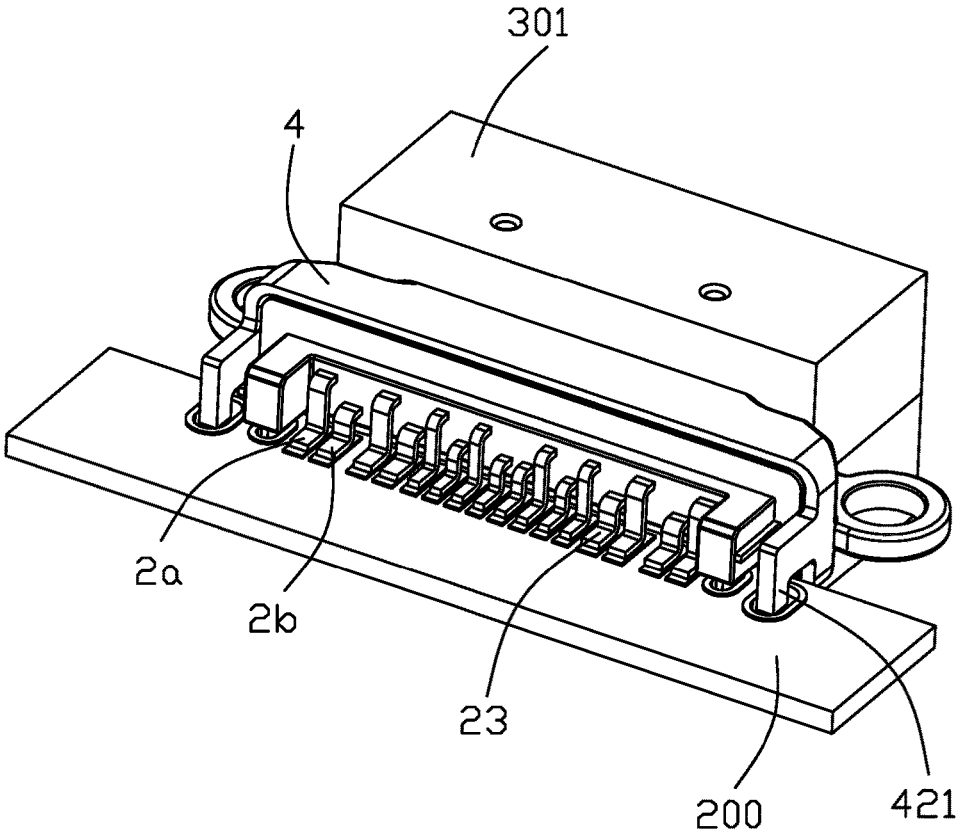
FIG. 2 is another assembled view taken from FIG. 1.
Figure 3:
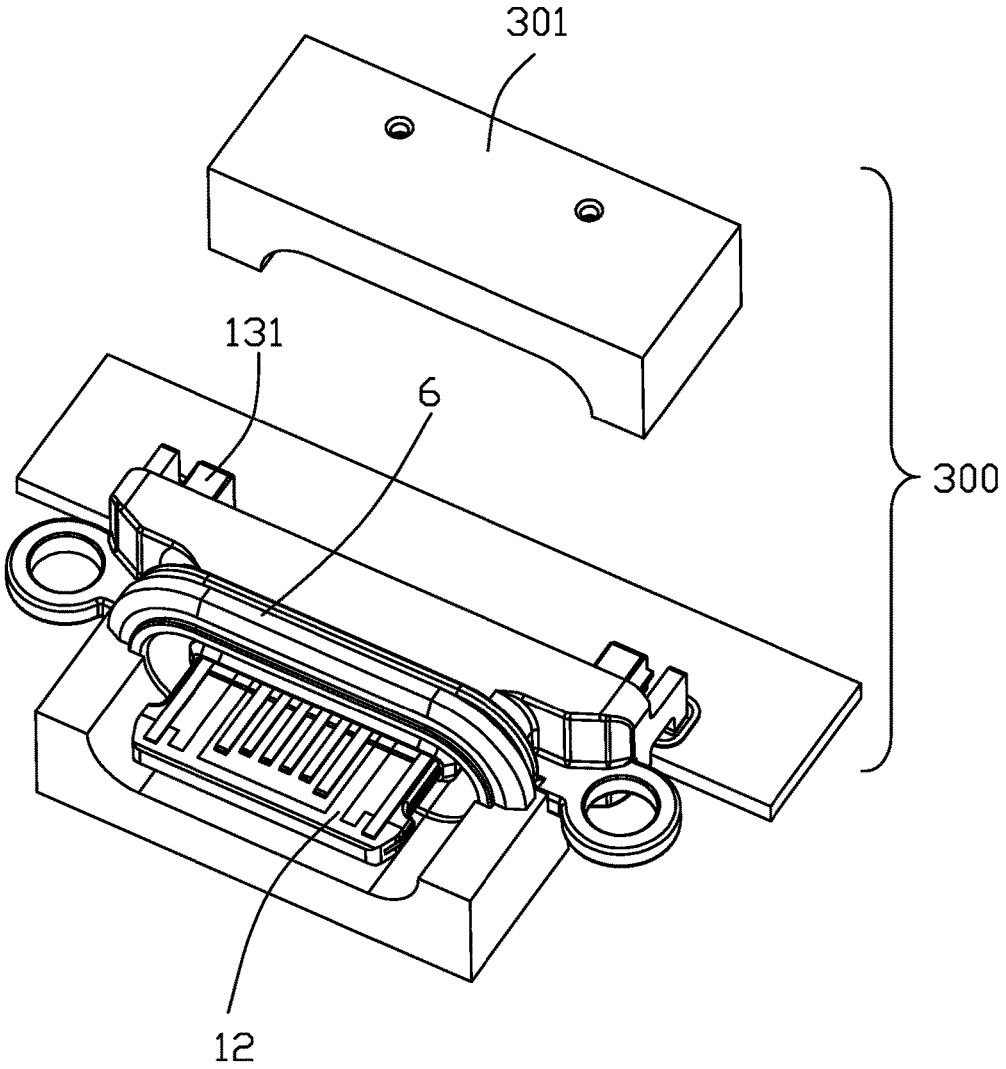
FIG. 3 is an exploded view of the electrical connector assembly removing half of the outer frame.
Figure 4:
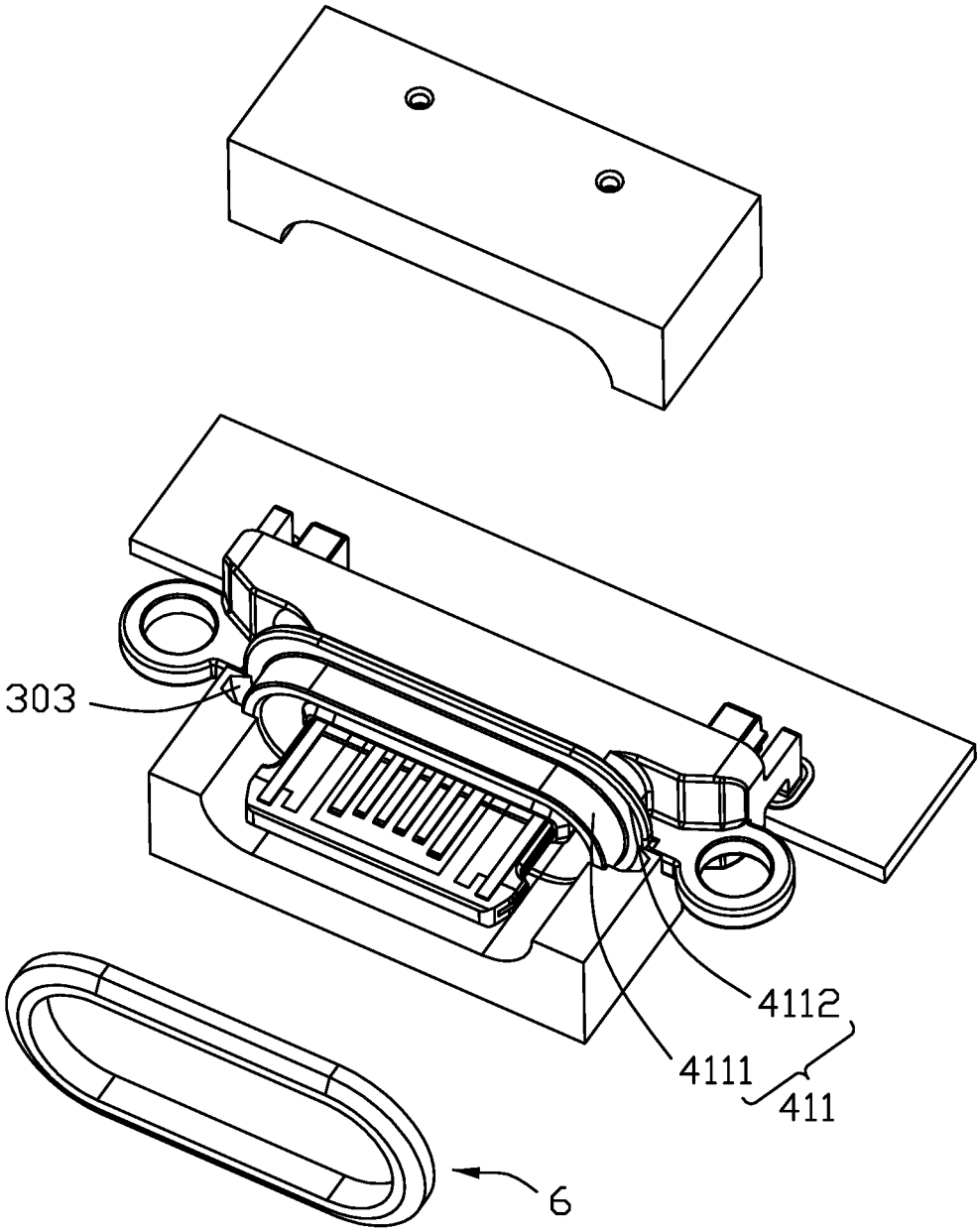
FIG. 4 is an exploded view of the electrical connector assembly removing an o-ring taken from FIG. 3.

Reference will now be made in detail to the embodiments of the present disclosure. Referring to FIGS. 1 to 12, the electrical connector assembly 300 includes an electrical connector 100 and an outer frame 301 partially receiving the electrical connector 100.

Referring to FIGS. 1 to 12, the electrical connector 100 includes a shielding shell 4. The outer frame 301 is a frame having a receiving space (not labeled). There exists an annular groove 302 between an inner wall of the outer frame 301 and an outer surface of the shielding shell 4. The outer frame 301 includes a pair of dispensing holes 304 penetrating the inner wall and an outer wall thereof and communicating with the annular groove 302. The annular groove 302 could be recessed in the inner wall of the outer frame 301. The annular groove 302 could be recessed in the outer surface of the shielding shell 4. In the preferred embodiment, the annular wall 302 is composed of a groove 303 recessed in the inner wall of the outer frame 301 and a first annular portion 4111 recessed in the outer surface of the shielding shell 4.

Referring to FIGS. 4 to 12, the electrical connector 100 includes a contact module, the shielding shell 4 receiving the contact module, a sub shell 5 fixed in a rear end of the shielding shell 4, an o-ring 6 attached to a front end of the electrical connector 100, and a sealer 7 sealing a rear end of the electrical connector 100.

Figure 5:
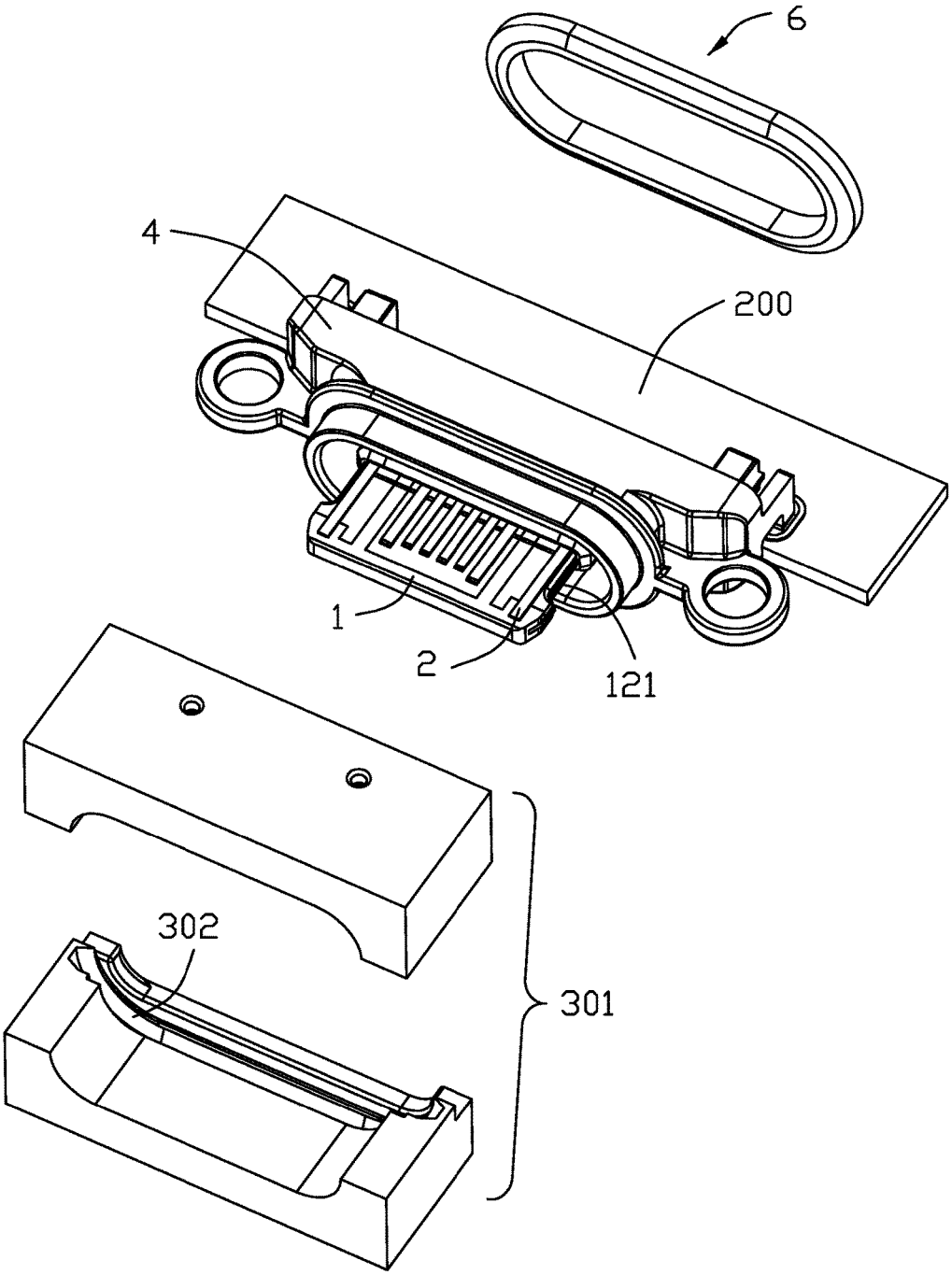
FIG. 5 is a partial exploded view of the electrical connector assembly.
Figure 6:
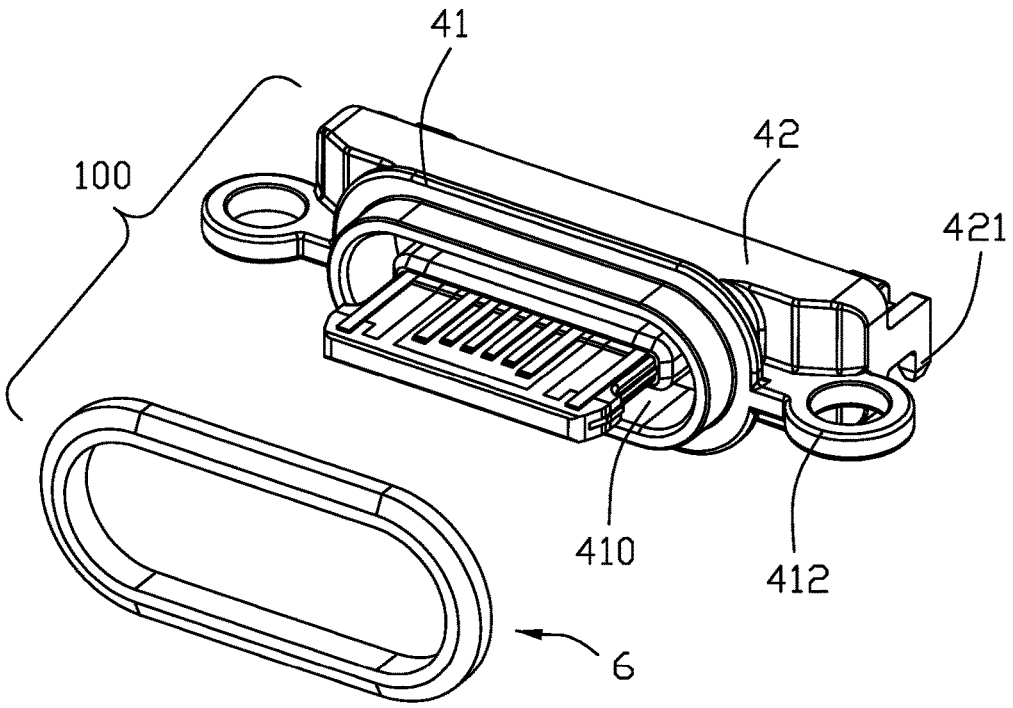
FIG. 6 is an exploded view of the o-ring and the other parts of the electrical connector.
Figure 8:
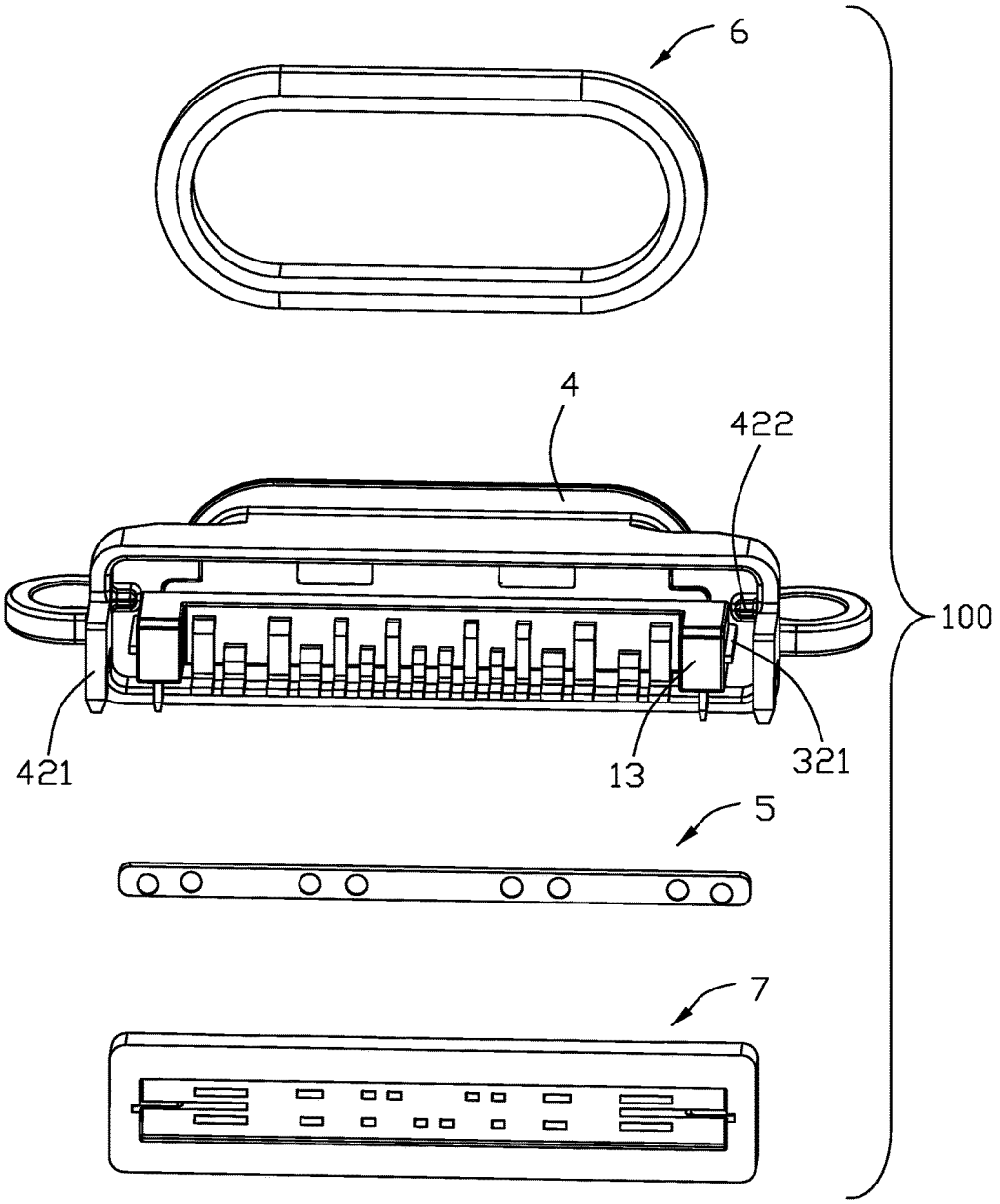
FIG. 8 is another exploded view of the electrical connector separating a sub shell taken from FIG. 7.
Figure 9:
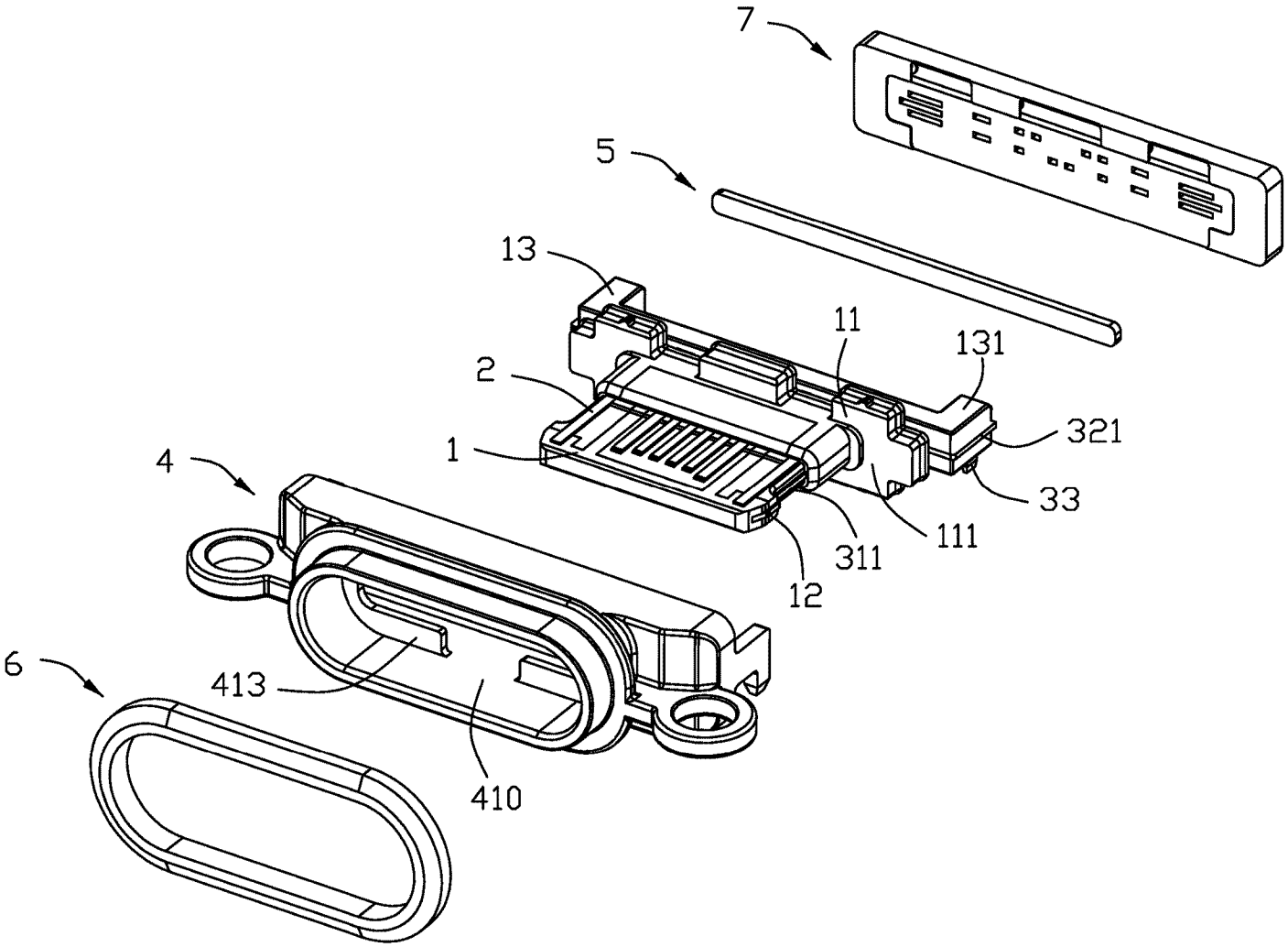
FIG. 9 is an exploded view of the electrical connector.
Figure 10:
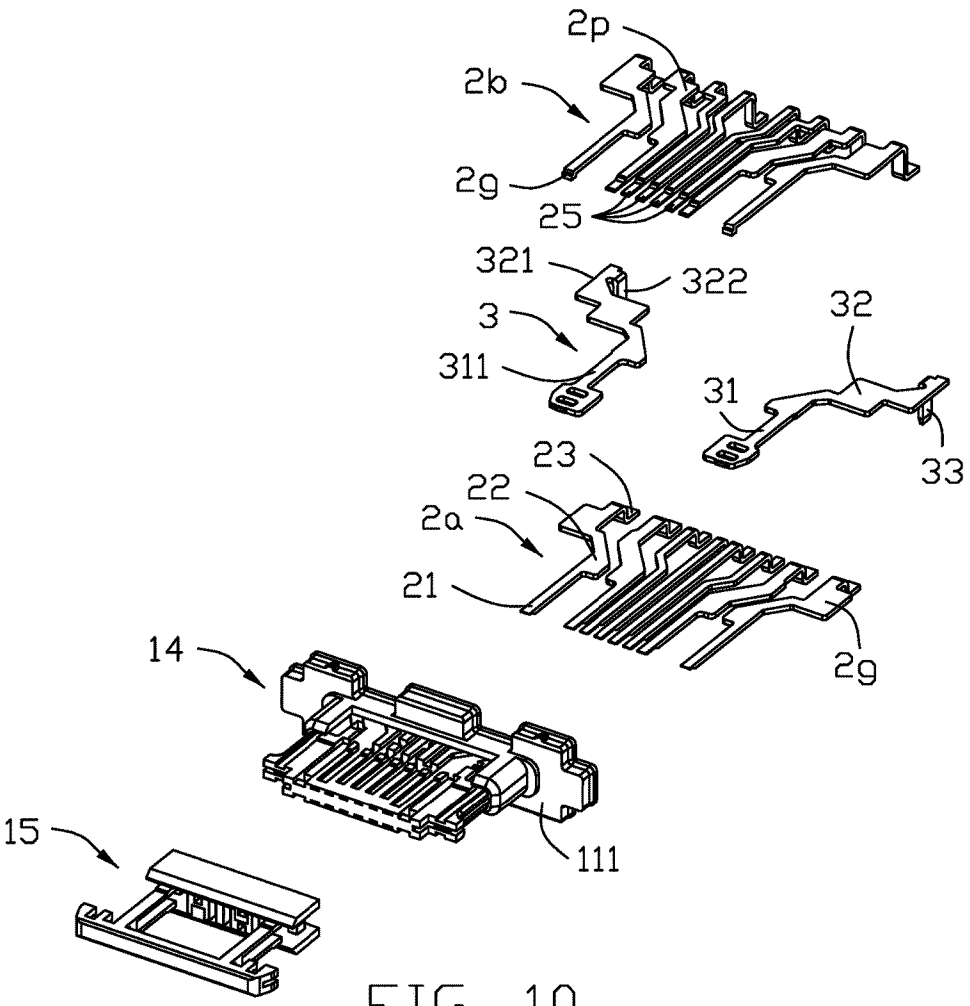
FIG. 10 is an exploded view of a contact module of the electrical connector.
Figure 11:
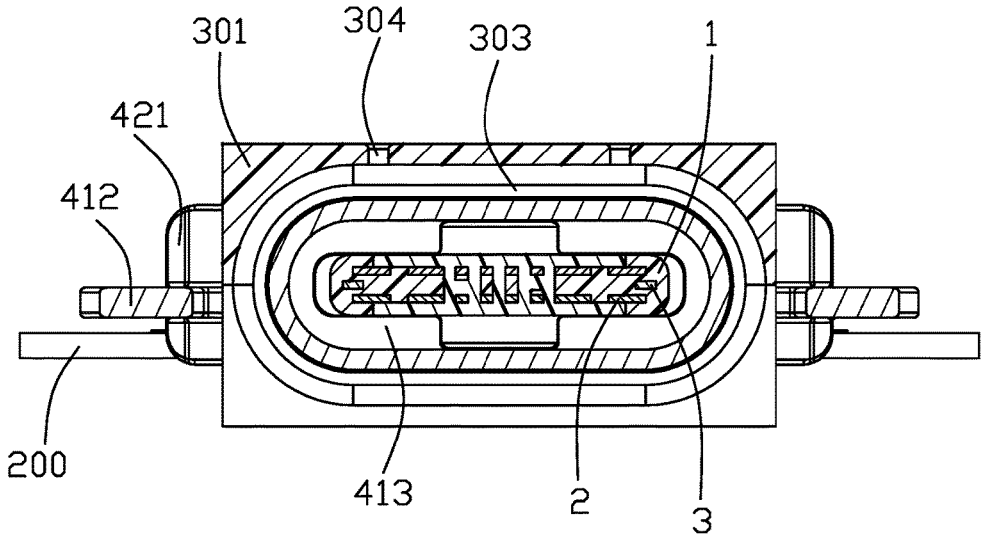
FIG. 11 is a cross-sectional view of the electrical connector assembly taken along line 11-11 in FIG. 1.
Figure 12:
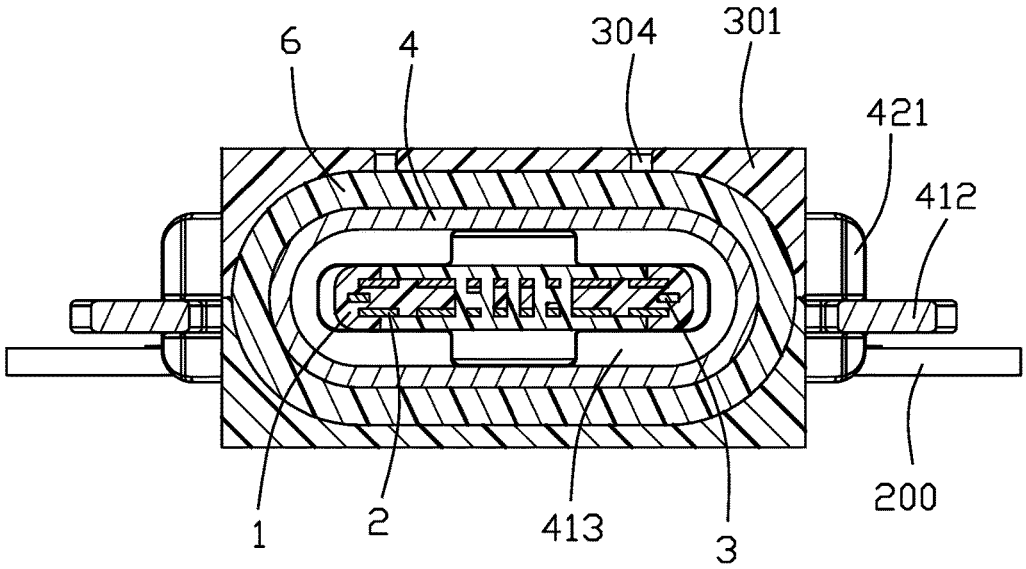
FIG. 12 is a cross-sectional view of the electrical connector assembly removing the o-ring taken from FIG. 11.

Referring to FIG. 5 and FIGS. 9 to 10, the contact module includes an insulative housing 1, a number of conductive terminals 2 affixed to the insulative housing 1, and a reinforcing member 3 affixed to the insulative housing 1. Referring to FIGS. 7 to 10, the insulative housing 1 includes a base portion 11 and a tongue portion 12 extending forwardly from the base portion 11. The base portion 11 includes a front surface 111 facing the tongue portion 12 and a rear surface 112 facing the sealer 7. The tongue portion 12 includes a pair of mating grooves 121 recessed in two lateral sides. The insulative housing 1 further includes a rear portion 13 located at a rear end of the base portion 11. The rear portion 13 includes a pair of protruding portions 131 extending rearward and separated from each other. The insulative housing 1 includes an insulative part 14 affixing with the conductive terminals 2 and an insulator 15 filling in the gap located at the insulative part 14 and forming the mating grooves 121.

Referring to FIGS. 7 to 12, each conductive terminal 2 includes a fixed portion 22 affixed to the base portion 11, a contacting portion 21 extending forwardly from the fixed portion 22 and exposed to the tongue portion 12, and a soldering portion 23 extending rearward from the fixed portion 22. The conductive terminals 2 include a row of upper terminals 2*a* and a row of lower terminals 2*b* in symmetry with the upper terminals 2*a*. Each row of conductive terminals 2 includes a pair of ground terminals 2*g* located at the outermost side, a pair of power terminals 2*p* located inside the ground terminals 2*g* and spaced two terminal positions from the ground terminals 2*g*, and four signal terminals 2*s* located between the pair of power terminals 2*p*. In a front-to-rear direction, the front end of the ground terminal 2*g* is further forward with respect to the front end of the power terminal 2*p*. The front end of the signal terminal 2*s* is further rearward with respect to the front end of the power terminal 2*p*. The soldering portions 23 of the upper terminals 2*a* and the lower terminals 2*b* are arranged in a row located at a rear end of the base portion 11 in a transverse direction perpendicular to the front-to-rear direction. The width of each of the ground terminal 2*g* and each of the power terminals 2*p* is larger than the width of each of the signal terminals 2*s*. The width of the soldering portion 23 of the ground terminal 2*g* is 0.4 mm which is same as that of the power terminal 2*p*. The distance between the soldering portion 23 of the ground terminal 2*p* and the soldering portion 23 of the power terminal 2*p* is 0.45 mm, which increases the safety degree and reduces the risk of short-circuiting of the tin.

Referring to FIGS. 7 to 10, the electrical connector 100 includes a pair of the reinforcing members 3 affixed to the insulative housing 1 and separated from each other. Each reinforcing member 3 includes a first supporting arm 31 affixed to the tongue portion 12, a second supporting arm 32 affixed to the base portion 11 and located behind the first supporting arm 31, and a pair of soldering pins 33 bending downwardly from the second supporting arm 32. The first supporting arm 31 includes a lateral edge 311 exposed laterally to the mating groove 121. The second supporting arm 32 includes an outside edge 321 exposed laterally to the protruding portion 131 and an inner edge 322 embedded in the protruding portion 131. The soldering pins 33 bend downwardly from the inner edge 322 and are partially embedded in the protruding portion 131.

Referring to FIGS. 3 to 9, the shielding shell 4 is a seamless structural metal injection molded. The shielding shell 4 includes a first/front cylindrical portion 41 located at a front end, a second/rear cylindrical/hollow portion 42 communicating with the first cylindrical portion 41 and located at a rear end thereof, and a pair of lateral portions 412 extending laterally from the first cylindrical portion 41 and affixed to a printed circuit board 200. The first cylindrical portion 41 includes a first receiving room 410, a stepped portion 411 located at a front end thereof, and a pair of barriers 413 received in the first receiving room 410 and disposed at a junction of the first cylindrical portion 41 and the second cylindrical portion 42. The barriers 413 extend rearward. The stepped portion 411 includes a first annular portion 4111 located at the front end of the first cylindrical portion 41 and extending in the front-to-back direction and a second annular portion 4112 protruding laterally and outwardly from the first annular portion 4111 in a vertical plane perpendicular to the front-to-back direction, and located at a rear end of the first annular portion 4111. The first annular portion 4111 of the stepped portion 411 is disposed corresponding to the groove 303 of the outer frame 301 such that the predetermined annular groove 302 is formed between the step portion 411 and the groove 303. The second cylindrical portion 42 has a rectangular parallelepiped shape and has a second receiving room 420 penetrating the first receiving room 410. The second annular portion 41 includes a pair of fixed pins 421 extending rearward and downwardly, and a pair of resisting walls 422 received in the second receiving room 420 and protruding into the second receiving room 420. The resisting walls 422 are integrated with a rear surface of the barriers 413.

Figure 7:
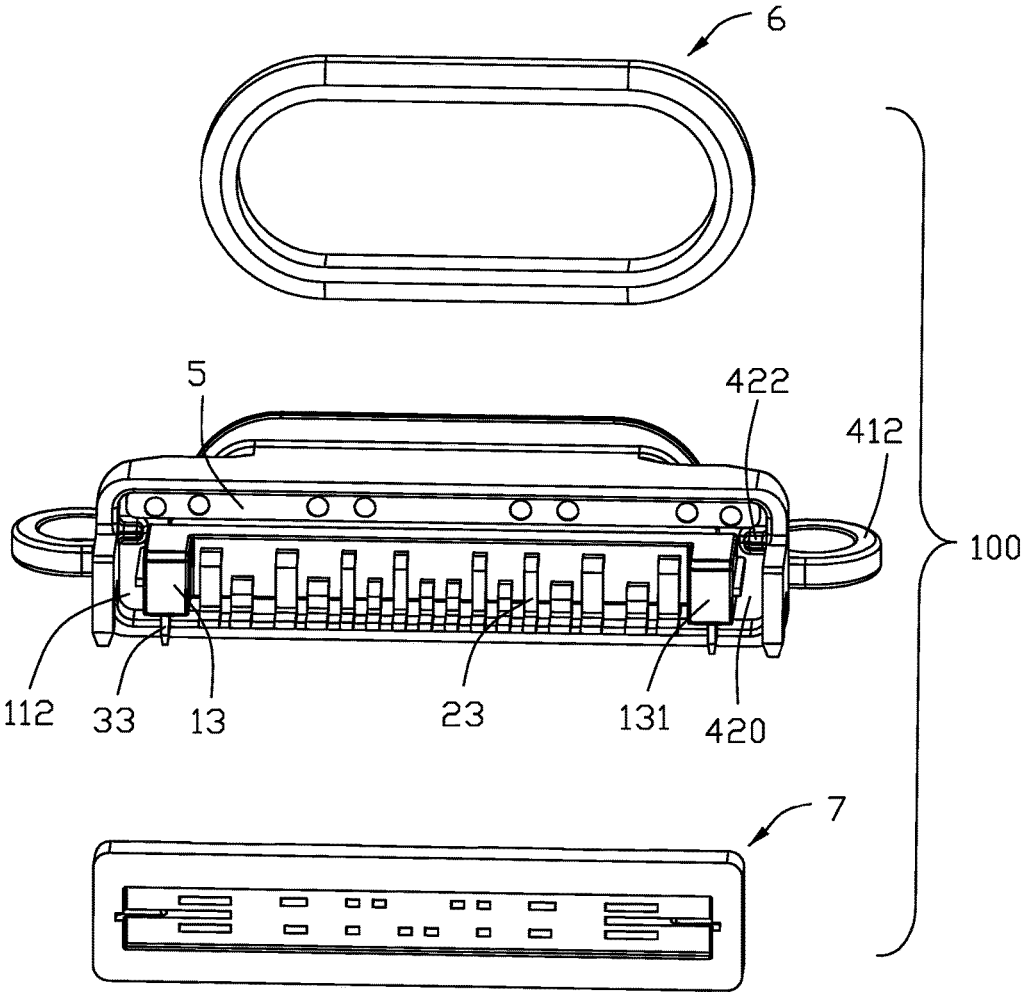
FIG. 7 is an exploded view of the o-ring, a sealer and the other parts of the electrical connector.

Referring to FIGS. 7 to 8, the electrical connector 100 includes a sub shell 5 spot-welded on the barriers 413 and erecting on the resisting walls 422. The sub shell 5 is shaped as a plate and affixed to the shielding shell 4. The resisting walls 422 are disposed higher than the protruding portions 131 such that the sub shell 5 erected on the resisting walls 422 cannot contact the soldering portions 23 of the conductive terminals 2 preventing the occurrence of a short circuit.

A method of making the electrical connector assembly 300 includes the following steps. Firstly the upper terminals 2*a*, the lower terminals 2*b* and the reinforcing member 3 are integrally formed with insulative materials to form a contact module and an insulative housing during the process. The lateral edges 311 of the first supporting arm 31 are exposed laterally to the mating grooves 121 and mated with a mated electrical connector. The outside edge 321 of the second supporting arm 42 is exposed outwardly to the protruding portion 131. It should be noted that, in this embodiment, the outside edge 321 does not contact the inner surface of the shielding shell 4, and in other embodiments, the outside edge 321 is in contact with the inner surface of the shielding shell 4 to better achieve the grounding effect. During the process, the reinforcing members 3 bend vertically downwardly from its inner edge 322. Since the inner edge 322 is embedded in the protruding portion 131, the soldering pins 23 are also partially embedded in the protruding portion 131. Therefore, the protruding portion 131 can isolate the soldering portions 23 of the conductive terminals 2 from the soldering pins 33 of the reinforcing member 3.

Secondly provide the shielding shell 4 having a stepped portion 411. The shielding shell 4 includes a pair of barriers 413 having a pair of resisting walls 422.

Thirdly assemble the contact module to the shielding shell 4 along a rear-to-front direction. The tongue portion 12 is partially received in the first receiving room 410 and extends forwardly outwardly from the first receiving room 410. The base portion 11 is received in the second receiving room 420. The protruding portion 131 protrudes outwardly from the second receiving room 420. The barriers 413 resist against the front surface 111. The rear surface of the barrier is flush with the rear surface 112. The resisting walls 422 protrude from the rear surface 112 to extend rearward. The resisting walls 422 are disposed out of the pair of protruding portions 131 and higher than the protruding portion 131.

Fourthly provide a sub shell 5 made of metal. The sub shell 5 is spot-welded to the rear of the barriers 413 and the rear surface 112 of the base portion. The two ends of the sub shell 5 are erected on the pair of resisting walls 422. The sub shell 5 and the soldering portions 23 of the conductive terminals 2 are separated from each other by the protruding portion 131 to prevent a short circuit from occurring.

Fifthly the sealer 7 is formed at the rear end of the electrical connector 100.

Sixthly provide the outer frame 301 having a pair of dispensing holes 304 and an annular groove 302 communicating with the dispensing holes 304. The assembled electrical connector 100 is assembled to the outer frame 301 such that the groove 303 forms an annular groove 302 corresponding to the first annular portion 4111 of the step portion 411. A portion of the tongue 12 extending from the first receiving room 410 is received in the outer frame 301 at this time.

Seventhly provide a glue, pour glue from the dispensing holes 304 into the annular groove 302, forming the o-ring 6 after solidification.

Compared with the prior art, the electrical connector is assembled into the outer frame (or other electronic device) without the o-ring 6, and then the glue is poured into the annular groove from the dispensing holes. In the annular groove 302, the o-ring 6 is formed after solidification. The design can better seal the gap between the electrical connector 100 and the outer frame 301 (or other electronic device), and the waterproof effect is better. Notably, in the embodiment an interior surface of the outer frame forms the capsular receiving cavity in compliance with that of the first cylindrical portion 41 to allow the tongue portion 12 to extend thereinto so as to compliantly receive the plug connector therein.

While the preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector assembly comprising:

an electrical connector including:

an insulative housing having a base portion and a tongue portion extending forwardly from the base portion;

a plurality of conductive terminals affixed to the insulative housing; and a shielding shell enclosing the insulative housing and affixing with the base portion; and an outer frame receiving the electrical connector; wherein an annular groove is formed between an outer surface of the shielding shell and an inner wall of the outer frame, the outer frame has a plurality of dispensing holes penetrating the inner wall and an outer wall thereof and communicating with the annular groove, and an o-ring is formed by injecting insulative materials into the annular groove through the dispensing holes to seal a gap between the shielding shell and the outer frame;

the shielding shell comprises a pair of barriers at a junction of the first cylindrical portion and the second cylindrical portion, the barriers resist a front surface of the base portion, and the sub shell is spot-welded on the rear surface of the barriers; and the electrical connector comprises a sub shell secured to the barriers.

2. The electrical connector assembly as claimed in claim 1, wherein the annular groove is recessed in the inner wall of the outer frame.

3. The electrical connector assembly as claimed in claim 2, wherein the shielding shell comprises a second annular portion at the outer surface, and the annular groove corresponds to a periphery of a front portion of the second annular portion.

4. The electrical connector assembly as claimed in claim 3, wherein the shielding shell is recessed with a first annular portion at the front portion of the second annular portion, and the first annular portion corresponds to the annular groove.

5. The electrical connector assembly as claimed in claim 1, wherein the shielding shell comprises a first cylindrical portion having a first receiving room and located at a front portion thereof and a second cylindrical portion having a second receiving room and located behind the first cylindrical portion, and the tongue portion extends forwardly and outwardly from the first receiving room and received in the outer frame.

6. The electrical connector assembly as claimed in claim 5, wherein the electrical connector comprises a rear portion located behind the base portion, the rear portion comprises a pair of protruding portions protruding rearward from the second receiving room and located at two lateral sides thereof, the shielding shell comprises a pair of resisting walls located at an inner surface and protruding into the second receiving room, and the resisting walls are higher than the protruding portions.

7. The electrical connector assembly as claimed in claim 6, wherein a rear surface of the barriers is flush with a rear surface of the base portion, and the resisting walls are integrally formed on the rear surface of the barriers.

8. The electrical connector assembly as claimed in claim 1, wherein the electrical connector comprises a pair of reinforcing members affixed to the insulative housing and separated from each other, each reinforcing member comprises a first supporting arm affixed to the tongue portion and a second supporting arm affixed to the base portion, the first supporting arm comprises a lateral edge exposed laterally to the tongue portion, the second supporting arm comprises an outside edge exposed laterally to the base portion, an inner edge embedded in the base portion, and a pair of soldering pins bending downwardly from the inner edge and partially embedded in the base portion.

9. The electrical connector assembly as claimed in claim 1, wherein each conductive terminal comprises a fixed portion affixed to the base portion, a contacting portion extending forwardly from the base portion and exposed to the tongue portion, and a soldering portion extending rearward from the fixed portion, the conductive terminals comprise a row of upper terminals and a row of lower terminals, each row of conductive terminals comprise a pair of ground terminals located at the outermost side, a pair of power terminals located inside the ground terminals and spaced two terminal positions from the ground terminals, and a plurality of signal terminals located between the pair of power terminals, the width of each soldering portion of the ground terminal and the power terminal is 0.4 mm, and the gap between the soldering portion of the ground terminal and the soldering portion of the adjacent power terminal is 0.45 mm.

10. A method of making an electrical connector assembly, comprising steps of:

providing a contact module including an insulative housing and a plurality of conductive terminals affixed to the insulative housing, said housing including a base portion and a tongue portion extending forwardly from the base portion in a front-to-back direction;

providing a shielding shell including a front cylindrical portion and a rear hollow portion in the front-to-back direction, said front cylindrical portion having a first annular portion extending forwardly along said front-to-back direction;

forwardly inserting the contact module into the shielding shell along said front-to-back direction to extend the tongue portion forwardly beyond the portion shielding shell;

providing an outer frame to surround both the front cylindrical portion and the tongue portion, said outer frame forming an annular groove at an interior surface thereof to surround and be closed by the first annular portion of the front cylindrical portion and at least one dispensing hole communicating with the annular groove; and pouring a glue liquid from the dispensing hole into the annular groove to form an o-ring which intimately adheres to both the outer frame and the first annular portion.

11. The method as claimed in claim 10, further including a step of securing a sub shell to the shielding shell to prevent a backward movement of the housing.

12. The method as claimed in claim 10, wherein the front cylindrical portion further includes a second annular portion extending laterally and outwardly from the first annular portion and intimately located behind the o-ring.

13. The method as claimed in claim 10, wherein the interior surface of the outer frame forms a capsular receiving cavity dimensioned compliant with the front cylindrical portion for snugly receiving a plug connector mated with the tongue portion.

14. An electrical connector assembly comprising:

a contact module including an insulative housing and a plurality of contacts retained to the housing, said housing including a base portion and a tongue portion extending forwardly from the base portion in a front-to-back direction;

a metallic shell enclosing the contact module and having a front cylindrical portion beyond which the tongue portion forwardly extends in the front-to-back direction;

an outer frame enclosing both the front cylindrical portion and the tongue portion and having an annular groove surrounding and closed by said front cylindrical portion; and a glue ring fills said annular groove in an adhesive manner; wherein the outer frame forms at least one dispensing hole communicating the annular groove with an exterior for injection of the glue ring.

15. The electrical connector assembly as claimed in claim 14, wherein said front cylindrical portion includes a first annular portion extending in the front-to-back direction, and a second annular portion laterally and outwardly from the first annular portion in a vertical plane perpendicular to the front-to-back direction, and said glue ring positioned upon both the first annular portion and the second annular portion.

16. The electrical connector assembly as claimed in claim 14, wherein said outer frame includes an interior surface, in which the annular groove is formed, to form a capsular receiving cavity dimensioned in compliance with a configuration of said front cylindrical portion.

17. The electrical connector assembly as claimed in claim 14, further including a metallic sub shell secured to the shell for preventing backward movement of the housing.

18. The electrical connector assembly as claimed in claim 14, wherein said outer frame includes two parts stacked with each other in vertical direction perpendicular to the front-to-back direction.

* * * * *